US005984395A

United States Patent [19]

Halpen

[11] Patent Number: 5,984,395

[45] Date of Patent: Nov. 16, 1999

[54] GOLF CLUB SUPPORT AND CARRYING DEVICE

[76] Inventor: William F. Halpen, 7073 Deer Point La., West Palm Bech, Fla. 33411

[21] Appl. No.: 09/122,538

[22] Filed: Jul. 24, 1998

[51] Int. Cl.[6] ..... A63B 55/00

[52] U.S. Cl. ..... 294/143; 294/159; 206/315.6; 211/70.2

[58] Field of Search ..... 294/137, 141–143, 294/146, 159; 206/315.2, 315.3, 315.6, 443; 211/70.2, 70.8; 248/96, 371; 473/282

[56] References Cited

U.S. PATENT DOCUMENTS

| | | | |
|---|---|---|---|
| 2,799,315 | 7/1957 | Strasburg | 206/315.2 |
| 3,164,185 | 1/1965 | Ingoldt | 294/143 |
| 3,866,646 | 2/1975 | Nevard | 294/159 |
| 3,966,051 | 6/1976 | Hollister et al. | 294/143 |
| 4,200,131 | 4/1980 | Chitwood et al. | 211/70.2 |
| 4,371,022 | 2/1983 | Goulart | 294/137 |
| 5,102,529 | 4/1992 | Hickin | 206/315.3 |
| 5,230,507 | 7/1993 | White et al. | 473/282 |
| 5,458,240 | 10/1995 | Rich et al. | 206/315.3 |
| 5,816,396 | 10/1998 | Shin | 206/315.2 |
| 5,829,604 | 11/1998 | Brophy | 211/70.2 |

*Primary Examiner*—Dean J. Kramer
*Attorney, Agent, or Firm*—McHale & Slavin

[57] ABSTRACT

A golf club storage and carrying device includes a plurality of tubular sleeves passing lengthwise through a rigid main body. Each sleeve is shaped and sized to accommodate a golf club shaft. The sleeve ends are capped by support members that prop the sleeves into an inclined orientation when the device is placed on a surface. A handle extends from a first side of the main body, and an attachment member extends from a second side of the main body. The attachment member may engage a mounting plate adapted to be attached to a golf club bag.

16 Claims, 2 Drawing Sheets

GOLF CLUB SUPPORT AND CARRYING DEVICE

FIELD OF THE INVENTION

This invention is directed to golf club carrying devices and, more particularly, to a transportable holder that is selectively attachable to a golf club bag.

BACKGROUND OF THE INVENTION

Golf is a game in which a golf ball is advanced around a preset course using a set of specially-designed clubs. Each club within the set is used for a particular type of shot that may be encountered during a given round of golf. Because no two rounds of golf are exactly the same, even when played on the same course, a golfer will bring a full set of clubs in order to be prepared for any shot that may arise. Then, as a round of golf is played, the golfer chooses from among the clubs in preparation for each shot.

As a group, the typical set of golf clubs can be quite cumbersome and somewhat heavy. Most golfers place their clubs in specially designed bags that, while not reducing club weight, do make the clubs somewhat easier to manage. Once collected into a golf club bag, the clubs are typically either loaded onto a car-like golf cart, placed onto a manual pushcart, or carried by a caddie.

In both tournament and non-tournament play, golfers who employ a caddie enjoy significant advantages not enjoyed by other golfers. One of the most important advantages is the ability to select an appropriate golf club while standing at the exact location of a given shot. Because a caddie carries a golfer's entire set of clubs, the golfer may wait to choose a club until he is directly next to his ball, thus eliminating the need to guess which club is appropriate.

Conversely, since carts are not allowed at all points on a golf course, golfers who use golf carts are required at times to make their golf club selection while only knowing the approximate location of their golf ball. Without knowing the exact nature of a given shot, it is difficult for a golfer to know exactly which club is most appropriate. Therefore, golfers often select and carry several clubs to the site where the golf ball is located. The golfer usually minimizes the number of clubs carried based on assumptions about the current lay of the golf ball. Depending upon the validity of these assumptions, the golfer may or may not be equipped to properly execute the golf shot. When the golfer has not correctly predetermined the correct golf club requirement, he must either walk back to the cart, which may be far away, or improvise with the clubs at hand. Commonly, the result is one or more missed shots and a higher-than-necessary golf score.

Some areas of a golf course are particularly difficult to assess from a distance. The area surrounding the greens, for example, is a particularly difficult area to read. This region requires a golfer to chose from among, and correctly execute, a variety of shots. Around the greens, shots commonly include putting, chipping, pitching, bump and run, and sand bunker exits. Since these shots are executed with different clubs, the variety of possible shots, coupled with uncertainty about golf ball location, makes selecting the appropriate club for near-the-green shots very difficult. For golfers who keep their equipment on a cart located some distance from their golf ball, shooting around a green can be unnecessarily frustrating.

Bringing a loose collection of clubs to the location of a given shot may also be risky. A golfer often lays the extra, non-used clubs on the ground while executing a shot. With this method, the clubs may be stepped on, the club grips may become contaminated with dirt and moisture, and stray clubs may even be left behind.

Numerous prior art devices have been proposed for carrying and supporting golf clubs. Typical of the prior art devices is the golf club carrier and support disclosed by White et al. (U.S. Pat. No. 5,230,507). White discloses a club carrier that is stored on the rim of a golf bag but requires that the golf club be inserted and removed from the device each time the device is used. Atalay (U.S. Pat. No. 5,209,539) discloses a portable and collapsible carrier that can be stored within a golf bag. The golf clubs are secured to the carrier along with golf balls and golf tees.

Thus, what is needed is a golf club support and carrying device that includes the advantages of the known devices, while addressing the shortcomings they exhibit. The device should allow a golfer to bring several clubs conveniently to the location of a given golf shot, while ensuring their safe retrieval after the shot. The carrier should also prevent the club heads from striking each other during transit. The device should also keep the club heads off the ground while the device is resting on the ground. The device should also ensure that the golf club grips are protected from damage or contamination from moisture. The device should also allow temporary attachment of the apparatus to a golf bag or golf cart.

SUMMARY OF THE INVENTION

The instant invention is a golf club support and carrying device that allows a golfer to safely transport a collection of golf clubs to and from locations remote from a golf cart. The device includes a series of uniform-length, tubular sleeves that extend lengthwise through a rectangular main body. The sleeves are parallel, and each sleeve has a first end spaced apart from a second end. As a group, the sleeve first ends are capped by a first support member, and the sleeve second ends are capped by a second support member. The first support member includes passthrough apertures that permit golf clubs to be inserted into, and removed from, the tubular sleeves as desired. Additionally, the support members prop the holding device into an inclined orientation when the device is placed on the ground. The incline ensures that clubs placed within the sleeves remain in place until selected for use.

A golf club head orienting fixture located on the first support member prevents the club heads of golf clubs placed within the device from striking each other. The orienting fixture includes positioning fingers that space apart and engage the head portion of each club placed within the sleeves.

The device may be removably mounted on a golf bag or cart via a hook-shaped attachment member that extends from the device main body. The attachment member engages a mounting plate disposed on the golf bag or cart that has been chosen to support the device. Each support member includes a curved edge shaped to follow the contours of a golf bag; these curved edges allow the device to be placed securely against a golf bag, if desired.

A pair of retractable legs pivotally extends from the first support member. The retractable legs will change the tubular sleeve incline, allowing the device to be used by golfers of different heights and varying degrees of flexibility.

Thus, an object of the instant invention is to provide a golf club support and carrying device that allows a golfer to bring several clubs conveniently to the location of a given golf shot.

An additional object of the present is to provide a golf club support and carrying device that protects unused golf clubs brought to the location of a golf shot, while ensuring their safe retrieval after the shot.

A further object of the present invention is to provide a golf club support and carrying device that prevents the club head portion of golf clubs from striking each.

Yet another object of the present invention is to provide a golf club support and carrying device that keeps the club heads off the ground while the device is resting on the ground.

Still another object of the present invention is to provide a golf club support and carrying device that protects golf club grips from damage or moisture contamination.

It is also an object of the present invention is to provide a golf club support and carrying device that promotes temporary attachment of the apparatus to a golf bag or golf cart.

It is still a further object of the present invention is to provide a golf club support and carrying device that is adjustable, usable by golfers of different heights and varying degrees of flexibility.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
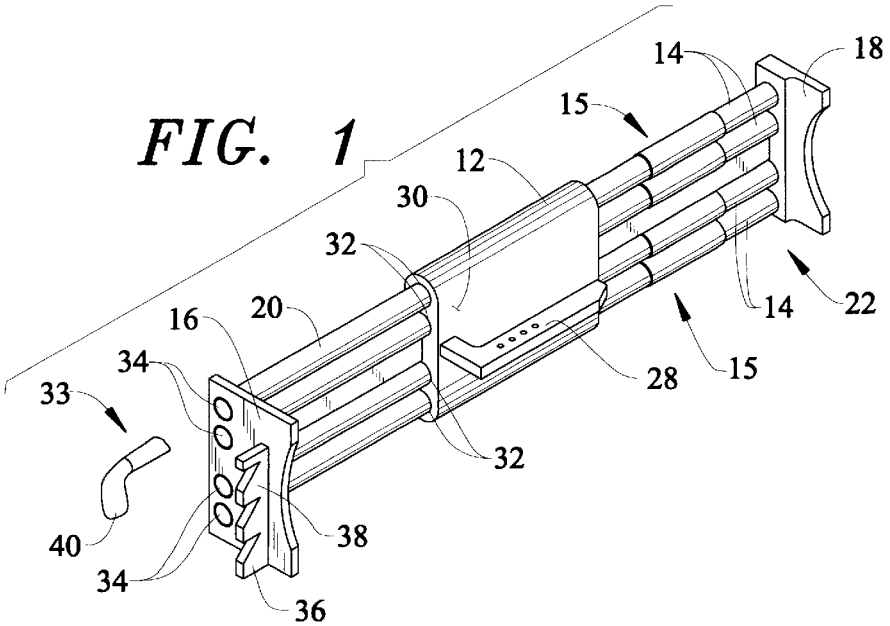
FIG. 1 is a perspective view of the golf club carrying and support device of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
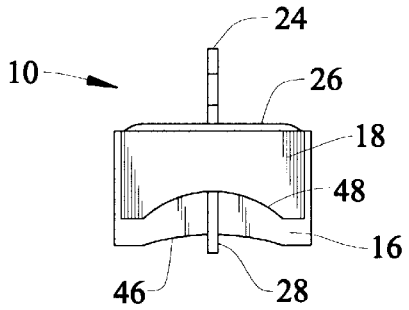
FIG. 2 is an end elevation view of the golf club carrying and support device shown in FIG. 1.

Now with reference to FIGS. 1 and 2, the golf club holding device 10 according to the present invention is shown. By way of overview, the holder 10 includes a rectangular main body 12 having a plurality of tubular sleeves 14 extending therethrough. The sleeves 14 are of uniform length, and are capped, as a group, by support members 16,18 located at opposite ends 20,22 of the sleeves. A grasping handle 24 extends from a first side 26 of the main body 12, and an attachment member 28 extends orthogonally from an opposite, second side 30 of the main body. Details of the golf club holder 10 will now be discussed in detail.

Figure 3:
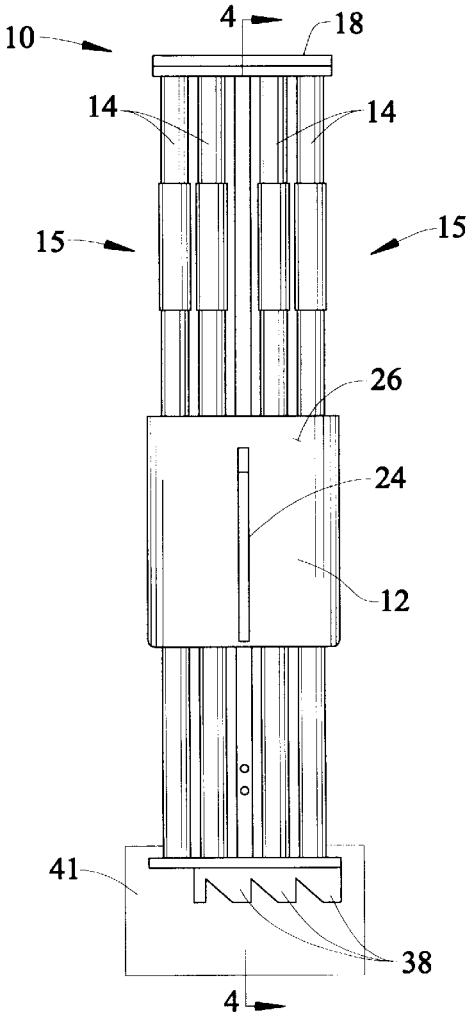
FIG. 3 is a top plan view of the golf club carrying and support device shown in FIG. 1.

As seen in FIGS. 1 and 3, the main body 12 is a substantially-rectangular unit characterized by four tunnels 32 extending lengthwise therethrough. The main body tunnels 32 each accommodate one of the tubular sleeves 14, and the main body 12 provides support to the mid region of each sleeve.

Figure 4:
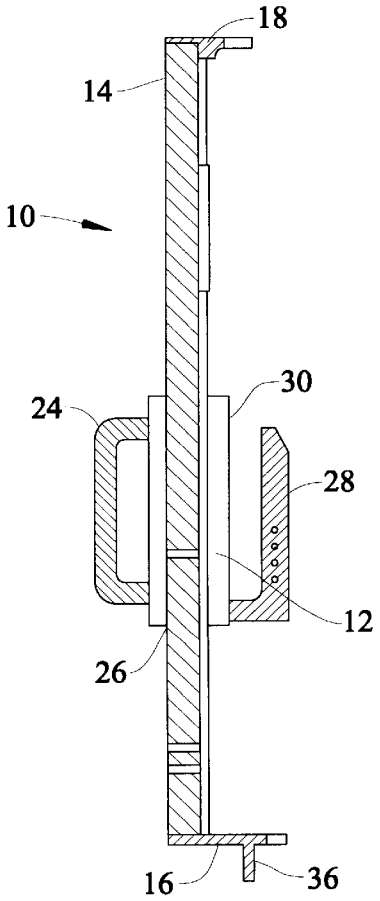
FIG. 4 is a section view of the golf club carrying and support device shown in FIG. 3, taken along section line 4—4.

As seen in FIGS. 2 and 4, the grasping handle 24 extends orthogonally from the main body 12. The handle 24 is centered on the main body first side 26 and is aligned parallel to the tubular sleeves 14. Although many handle 24 configurations are suitable, the preferred embodiment includes a handle 24 shaped to resemble an inverted "D."

The sleeves 14, themselves, are essentially hollow cylinders sized to accommodate golf clubs shafts 33. Each sleeve 14 has an open first end 20 and an opposite, closed second end 22. As seen in FIG. 1, the sleeves 14 each include a region 15 that telescopes. This telescoping region 15 advantageously allows the holder 10 to accommodate club sets of different lengths, while also producing a device that is collapsible for easy storage.

With additional reference to FIG. 4, the golf club holder 10 also includes a pair of support members 16,18 disposed at opposite ends 20,22 of the tubular sleeves 14. A first support member 16 abuts the tubular sleeve first ends 20, and a second support member 18 abuts the sleeve second ends 22. The first support member 16 includes a series of passthrough apertures 34 aligned with the tubular sleeve open first ends 20. These passthrough apertures 34 allow insertion of golf clubs 33 into the sleeves 14.

A notched head-orienting fixture 36 extends orthogonally from the first support member 16. The orienting fixture 36 is characterized by positioning fingers 38 sized and shaped to space apart the club head portion 40 of golf clubs 33 stored within the sleeves 14. As shown in FIG. 3, the holder 10 also includes a removable club head cover 41 that protects the club head portions 40 from rain damage. With this arrangement, the inserted golf clubs 33 are completely protected, yet remain readily available for transport and use.

An "L"-shaped attachment member 28 is mounted on the main body second side 30. The attachment member 28 extends from the main body 12 and is located approximately opposite the grasping handle 24. In keeping with the objects of the present invention, the attachment member 28 engages a mounting plate 42 that has been placed on a golf club bag 44. The mounting plate may be secured permanently to the bag 44 or, alternatively, may be clipped in place. In this manner, the device 10 may be stored on a golf bag 44, yet removed as needed, to transport an assortment of clubs to remote locations.

When the device 10 is brought to the site of a golf ball, the support members 16,18 cooperate to prop the tubular sleeves 14 into a slightly-inclined orientation. Because the sleeves 14 are inclined, clubs 33 inserted therein will remain in place until removed for use.

Figure 6:
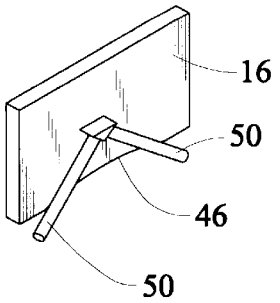
FIG. 6 is a close up view of the first support member and prop legs of the present invention.

As shown in FIG. 6, the first support member 16 also includes a pair of retractable prop legs 50. These legs 50 are pivotally connected to the first support member 16 and allow adjustable positioning of the sleeve first ends 20. In keeping with the objects of the present invention, the prop legs 50 enhance the usability of the device 10 by orienting the tubular sleeves in various orientations to accommodate golfers of different heights and who have varying degrees of flexibility. However, the prop legs 50 may be removed without loss of functionality.

Figure 5:
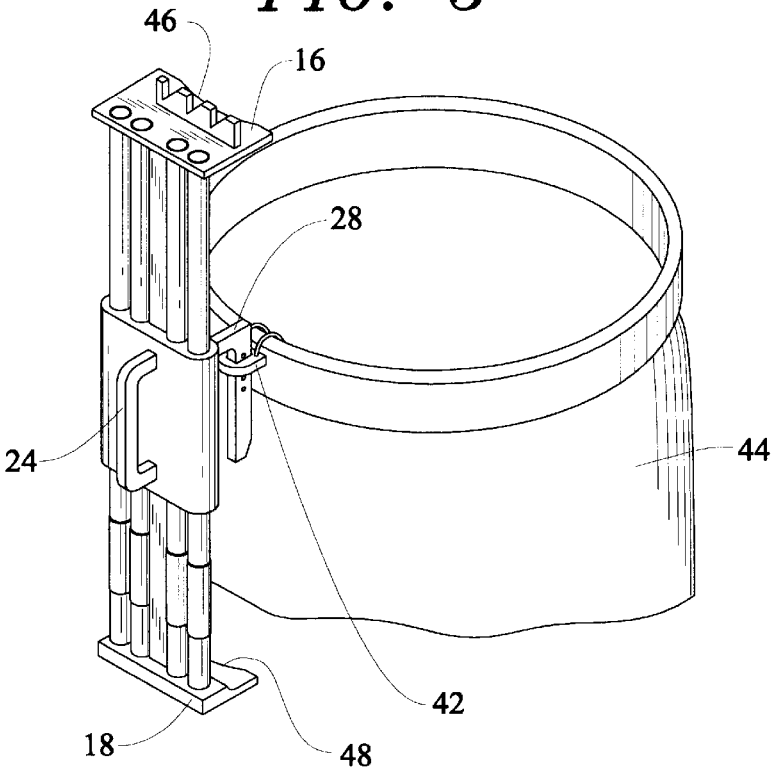
FIG. 5 is a pictorial view of the golf club carrying and support device of FIG. 1, shown in preparation for mounting on a golf bag.

As seen in FIGS. 1 and 5, the support members 16,18 are contoured to closely engage the outer surface of a golf bag 44. More particularly, each support member 16,18 includes a stabilizing arch 46,48 that cooperates with the attachment member 28 to keep the device 10 aligned vertically while the device 10 is attached to a golf bag 44.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A golf club support and carrying device comprising:

a rigid main body;

a plurality of sleeves attached to said main body, each sleeve having a first end and a second end;

a first support member attached to said sleeve first ends, said first support member including a plurality of passthrough apertures, each of said apertures axially aligned with one of said sleeves, said first support member including a contoured edge adapted to engage an outer surface of a golf bag;

a second support member attached to said sleeve second ends, said second support member including a contoured edge adapted to engage an outer surface of a golf bag;

at least one golf club head orienting fixture adapted to engage a head portion of a golf club inserted into one of said sleeves;

a handle extending from said main body; and an attachment member disposed on said main body, said attachment member being adapted to secure said golf club support and carrying device to a golf bag, whereby said sleeves are adapted to substantially encircle a golf club shaft and said support members maintain said sleeves in an inclined orientation when said support members are disposed against a surface.

2. The golf club support and carrying device of claim 1 wherein:

said head orienting fixture extends outwardly from said first support member.

3. The golf club support and carrying device of claim 1 further including:

a plurality of adjustable prop legs constructed and arranged to change the relative vertical position of said sleeve first ends with respect to said sleeve second ends.

4. The golf club support and carrying device of claim 1 further including, in combination therewith:

a mounting base adapted to be secured to a golf bag and being constructed and arranged to releasably engage said attachment member, thereby releasably securing said device to a golf bag.

5. A golf club support and carrying device comprising:

a rigid main body;

a plurality of sleeves attached to said main body, each sleeve having a first end and a second end;

a first support member attached to said sleeve first ends, said first support member including a plurality of passthrough apertures, each of said apertures axially aligned with one of said sleeves, said first support member including a contoured edge adapted to engage an outer surface of a golf bag;

a second support member attached to said sleeve second ends, said second support member including a contoured edge adapted to engage an outer surface of a golf bag;

a plurality of adjustable prop legs constructed and arranged to change the vertical position of said sleeve first ends with respect to said sleeve second ends;

at least one golf club head orienting fixture adapted to engage a head portion of a golf club inserted into one of said sleeves;

a handle extending from said main body; and an attachment member disposed on said main body, said attachment member being adapted to secure said golf club support and carrying device to a golf bag, whereby said sleeves are adapted to substantially encircle a golf club shaft and said support members maintain said sleeves in an inclined orientation when said support members are disposed against a surface.

6. The golf club support and carrying device of claim 5 wherein:

said head orienting fixture extends outwardly from said first support member.

7. The golf club support and carrying device of claim 5 further including, in combination therewith:

a mounting base adapted to be secured to a golf bag and being constructed and arranged to releasably engage said attachment member, thereby releasably securing said device to a golf bag.

8. A golf club support and carrying device comprising:

a rigid main body;

a plurality of sleeves attached to said main body, each sleeve having a first end and a second end;

a first support member attached to said sleeve first ends, said first support member including a plurality of passthrough apertures, each of said apertures axially aligned with one of said sleeves;

a second support member attached to said sleeve second ends; and an L-shaped attachment member disposed on said main body, said attachment member being adapted to suspend said golf club support and carrying device from a golf bag;

whereby said sleeves are adapted to substantially encircle a golf club shaft and said support members maintain said sleeves in an inclined orientation when said support members are disposed against a surface.

9. The golf club support and carrying device of claim 8 further including, in combination therewith:

a mounting base adapted to be secured to a golf bag and including a passthrough aperture sized to releasably engage said L-shaped attachment member, thereby releasably suspending said device from a golf bag.

10. The golf club support and carrying device of claim 9 further including:

a handle extending from said main body.

11. The golf club support and carrying device of claim 10 further including:

a plurality of adjustable prop legs constructed and arranged to change the relative vertical position of said sleeve first ends with respect to said sleeve second ends.

12. A golf club support and carrying device comprising:

a rigid main body;

a plurality of sleeves attached to said main body, each sleeve having a first end and a second end;

a first support member attached to said sleeve first ends, said first support member including a plurality of passthrough apertures, each of said apertures axially aligned with one of said sleeves, said first support member including a contoured edge adapted to engage an outer surface of a golf bag;

a second support member attached to said sleeve second ends, said second support member including a contoured edge adapted to engage an outer surface of a golf bag;

an attachment member disposed on said main body, said attachment member being adapted to secure said golf club support and carrying device to a golf bag;

a mounting base adapted to be secured to a golf bag and being constructed and arranged to releasably engage said attachment member, thereby releasably securing said device to a golf bag;

a handle extending from said main body; and a plurality of adjustable prop legs constructed and arranged to change the relative vertical position of said sleeve first ends with respect to said sleeve second ends;

whereby said sleeves are adapted to substantially encircle a golf club shaft and said support members maintain said sleeves in an inclined orientation when said support members are disposed against a surface.

13. The golf club support and carrying device of claim 12 further including:

at least one golf club head orienting fixture adapted to engage a head portion of a golf club inserted into one of said sleeves.

14. The golf club support and carrying device of claim 13, wherein:

said head orienting fixture extends outwardly from said first support member.

15. The golf club support and carrying device of claim 14, further including a capping member constructed and arranged to removably engage said sleeve first ends, said capping member being impervious to water.

16. The golf club support and carrying device of claim 14, wherein said sleeves are telescoping.

* * * * *